US006023913A

United States Patent [19]

Gray et al.

[11] Patent Number: 6,023,913

[45] Date of Patent: Feb. 15, 2000

[54] APPARATUS AND METHOD FOR WRAPPING SILVERWARE WITHIN A NAPKIN

[75] Inventors: Charles Woodard Gray, Tallahassee, Fla.; William Edward Brown, Nashville; Dwight Clanton, Shelbyville, both of Tenn.

[73] Assignee: Reginald M. Mudd, Lebanon, Tenn.; a part interest

[21] Appl. No.: 09/188,814

[22] Filed: Nov. 9, 1998

[51] Int. Cl.[7] ..... B65B 11/00; B65B 27/10

[52] U.S. Cl. ..... 53/399; 53/461; 53/465; 53/154; 53/587; 53/211; 53/218

[58] Field of Search ..... 53/399, 461, 465, 53/154, 148, 587, 209, 211, 216, 218, 219, 118, 119, 430

[56] References Cited

U.S. PATENT DOCUMENTS 4,601,154 7/1986 Ausnit ..... 53/119
5,237,801 8/1993 Hillam et al. .
5,428,941 7/1995 Staub ..... 53/119 X
5,469,688 11/1995 Dunbar ..... 53/461

*Primary Examiner*—Linda Johnson
*Attorney, Agent, or Firm*—Michael E. McKee

[57] ABSTRACT

An apparatus and method for wrapping a napkin about silverware items into a wrapped arrangement involves a worktable within which is provided an upwardly-opening trough for accepting a napkin and silverware items positioned therein. The napkin is automatically placed over the opening of the trough in a spread condition and then silverware items are automatically directed onto the napkin so that the silverware falls to the bottom of the trough thereby positioning the napkin between the silverware and the bottom of the trough. A rotatable blade is positioned within the trough for automatically spinning the napkin and silverware items about the longitudinal axis of the trough until the napkin and silverware items are wound in a wrapped arrangement. The wrapped arrangement is thereafter removed from the trough in preparation of a subsequent napkin-wrapping operation.

18 Claims, 6 Drawing Sheets

APPARATUS AND METHOD FOR WRAPPING SILVERWARE WITHIN A NAPKIN

BACKGROUND OF THE INVENTION

This invention relates generally to the food service industry and relates, more particularly, to the means and methods used to wrap a silverware within a napkin to form a wrapped arrangement for use in a place setting.

The steps commonly involved in manually wrapping silverware (i.e. also referred to in the art as eating utensils or flatware) within a napkin for use in a place setting at a table of a restaurant or other food service establishment include the steps of placing a napkin in a spread condition upon a flat surface, positioning a set of silverware in a gathered condition upon the napkin, and then wrapping the napkin about the silverware until the entirety of the napkin is wound about the silverware. If desired, the wrapped arrangement can be banded to help maintain its wrapped condition until ready for use (i.e. placed at a table). These manual steps are quite time-consuming and at large eating establishments, normally require a great deal of manpower which could otherwise be devoted to other tasks.

There is described in U.S. Pat. No. 5,469,688 an apparatus for automatically wrapping a napkin about silverware. This apparatus, however, is limited in that it does not automatically place a napkin in a condition for accepting silverware placed thereon nor does it automatically place the silverware upon the napkin. Instead, these steps must be manually performed before the wrapping operation is effected. It would be desirable to provide a napkin-wrapping apparatus which automatically places a napkin in position for accepting silverware placed thereon, as well as automatically wrapping the napkin around the silverware.

Accordingly, it is an object of the present invention to provide a new and improved apparatus and method for automatically wrapping a napkin about silverware.

Another object of the present invention is to provide such an apparatus which is capable of preparing a large quantity of wrapped silverware arrangements in much less time than would be required to manually prepare the wrapped arrangements.

Still another object of the present invention is to provide such an apparatus which performs the wrapping steps automatically.

Yet another object of the present invention is to provide such an apparatus which is uncomplicated in construction yet effective in operation.

SUMMARY OF THE INVENTION

This invention resides in an apparatus and method for wrapping a napkin about an item of silverware.

The apparatus of the invention includes a frame and means supported by the frame defining an elongated, substantially horizontally-disposed trough having a bottom and an upwardly-directed opening. The trough opening is adapted to accept a napkin and an item of silverware positioned therein in preparation of a napkin-wrapping operation so that when a napkin and an item of silverware are accepted by the trough, the napkin is disposed between the item of silverware and the bottom of the trough. An elongated blade is positioned within the trough and supported substantially parallel to the longitudinal axis of the trough, and means are connected to the frame for rotating the blade about the longitudinal axis of the trough so that following acceptance of a napkin and an item of silverware by the trough as aforedescribed, the blade can be rotated about the longitudinal axis of the trough to wrap the napkin about the silverware item into a wrapped arrangement.

In an alternative embodiment of the apparatus, the apparatus includes means for automatically moving a napkin from a supply of napkins to a spread condition over the trough at which the central section of the napkin spans the width of the upwardly-directed opening of the trough and means for automatically delivering an item of silverware from a supply of silverware items onto the napkin spread over the trough so that the delivered item of silverware falls into the trough with the napkin so that the central section of the napkin is positioned between the delivered item of silverware and the bottom of the tough.

The method of the invention includes the steps performed by the apparatus of the invention. More specifically, an elongated, substantially horizontally-disposed trough is provided wherein the trough has a bottom and an upwardly-directed opening for accepting a napkin and an item of silverware positioned therein in preparation of a napkin-wrapping operation. A napkin is placed over the opening of the trough so that the napkin spans the width of the trough, and an item of silverware is delivered to the napkin so that the silverware item and napkin fall into the trough under the weight of the silverware item and so that the napkin is disposed between the silverware item and the bottom of the trough. The napkin and silverware item are thereafter spun about the longitudinal axis of the trough so that the napkin is wrapped about the silverware item into a wrapped arrangement.

DETAILED DESCRIPTION OF THE ILLUSTRATED EMBODIMENT

Figure 1:
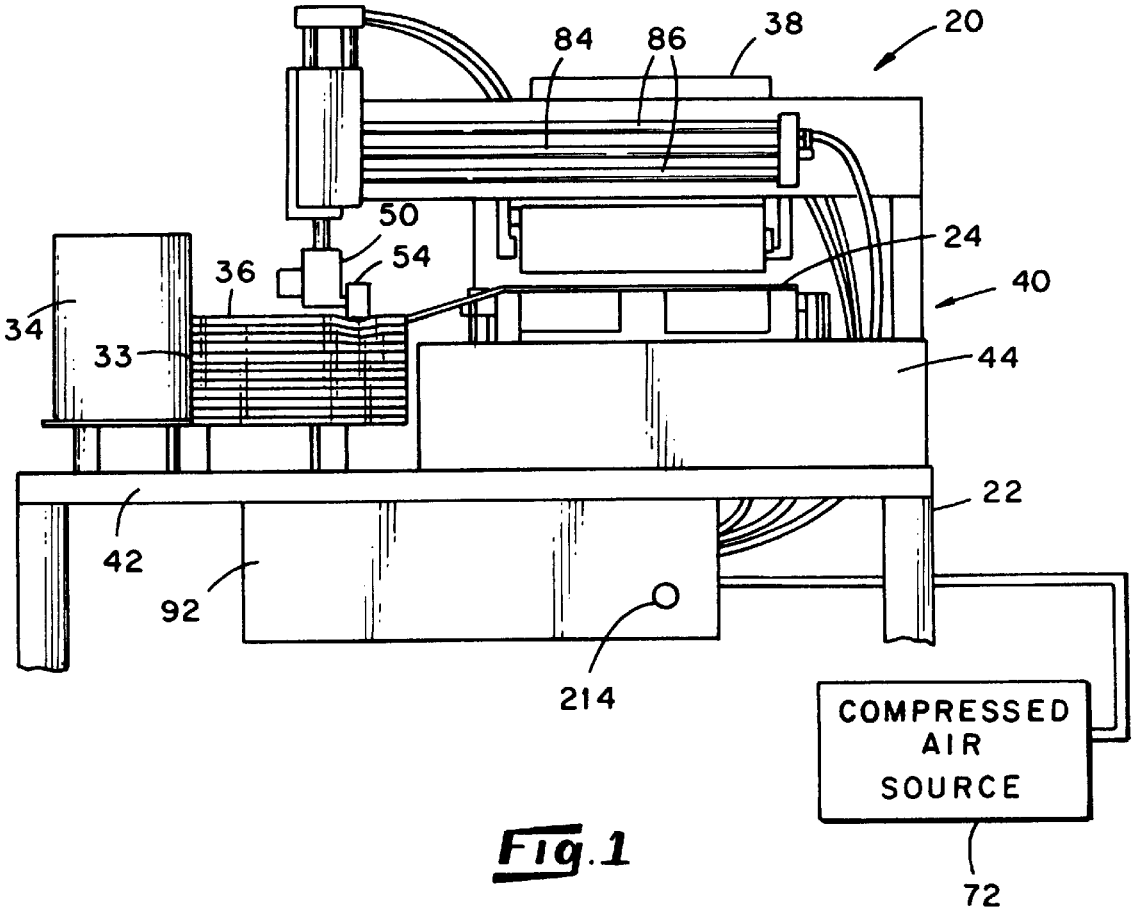
FIG. 1 is an elevation view of an embodiment of the apparatus of the present invention.
Figure 2:
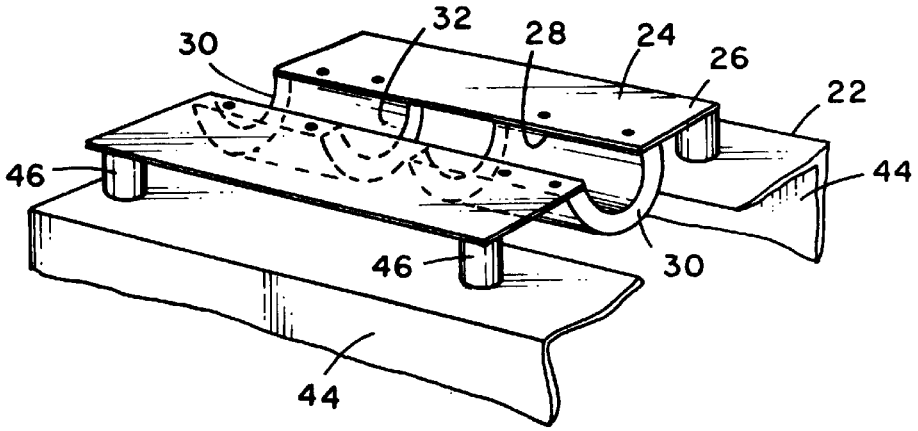
FIG. 2 is a fragmentary perspective view of the worktable of the FIG. 1 embodiment at which the wrapping operation is carried out.

Turning now to the drawings in greater detail, there is shown in FIG. 1 an embodiment, generally indicated 20, of a napkin-wrapping apparatus within which features of the present invention are embodied. The apparatus 20 includes a frame 22 and a worktable 24 supported by the frame 22. As best shown in FIG. 2, the worktable 24 includes a substantially horizontal upper surface 26, and there is provided within the surface 26 an elongate opening 28. A pair of upwardly-opening channel members 30 are attached to the underside of the worktable 24 so as to span the width of the opening 28 and thereby provide an upwardly-opening trough 32 in the worktable 24 which is accessible through the opening 28. As will be apparent herein, the worktable 24 is the site to which a napkin and silverware are delivered for a napkin-wrapping operation, and the trough 32 is the site at which the napkin-wrapping operation is carried out.

With reference still to FIG. 1, the apparatus 20 includes a napkin storage bin 34 disposed at one end of the frame 22 for supporting a stack 33 of paper napkins 36 for use during napkin-wrapping operations, and a plurality of silverware bins 38 are supported by the frame 22 at an elevated position relative to the worktable 24 for holding a quantity of silverware items (e.g. forks, spoons, knives) to be wrapped within napkins. During operation of the apparatus 20, a napkin 36 is automatically moved from the top of the napkin stack 33 and placed in a spread condition upon the worktable surface 26 so as to span the width of the trough 32, and then the silverware items are gravitationally directed from the storage bins 38 and onto the portion of the napkin 36 which directly overlies the trough 32. When the silverware items fall upon the napkin 36, the napkin 36 falls into the trough 32 under the weight of the silverware items, and it is within the trough 32 that a napkin-wrapping operation is carried out.

For effecting the wrapping of a napkin 36 about the silverware items positioned within the trough 32, the apparatus 20 includes means, generally indicated 40 in FIG. 1, for spinning the napkin 36 within the trough 32 and thereby wrapping the napkin 36 about the silverware. After removing the wrapped napkin arrangement from the trough 32, a subsequent napkin-wrapping operation is initiated by positioning another napkin 36 from the napkin stack upon the worktable 24 and directing additional silverware items from the silverware bins 38 onto the spread napkin.

With reference still to FIGS. 1 and 2, the frame 22 includes a legged table 42, and the worktable 24 is supported atop the table 42 at a convenient working height. Platen-like side members 44 and round posts 46 support the worktable 24 in an elevated condition above the surface of the legged table 42 to accommodate the channel members 30 and other components, described herein, positioned beneath the worktable 24.

For automatically moving a napkin 36 from the top of the stack 33 to the worktable 24 and with reference to FIGS. 3–10, the apparatus 20 includes a pick-up system 48 including a pick-up head 50 adapted to pick up the top napkin 36 from the stack 33 and transport means 52 for transporting the pick-up head 50 and napkin 36 from the stack 33 to the worktable 24. More specifically, the transport means 52 includes an elevator system 54 having a vertically-movable carriage 56 from which the pick-up head 50 is supported and further includes a horizontally-movable carriage 58 upon which the elevator system 54 is mounted.

Figure 4:
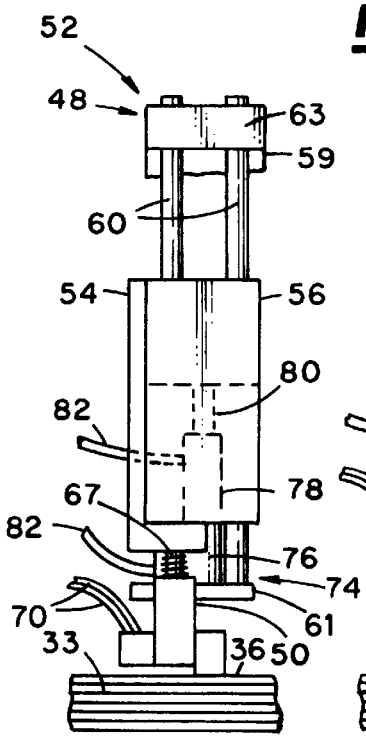
FIGS. 4 and 5 are side elevational views of a fragment of the napkin pick-up system of the FIG. 1 embodiment illustrating the pick-up head in alternative positions.
Figure 5:
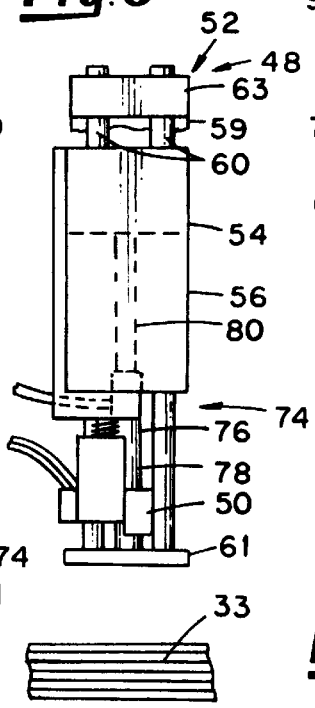
Figure 6:
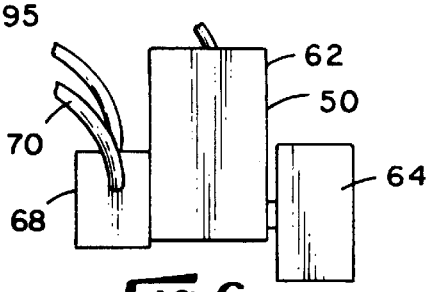
FIG. 6 is a side elevation view of the pick-up head of FIGS. 4 and 5, but drawn to a slightly larger scale.
Figure 7:
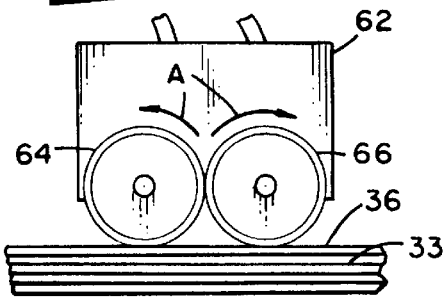
FIGS. 7 and 8 are front elevational views of the pick-up head illustrated in FIG. 6.
Figure 8:
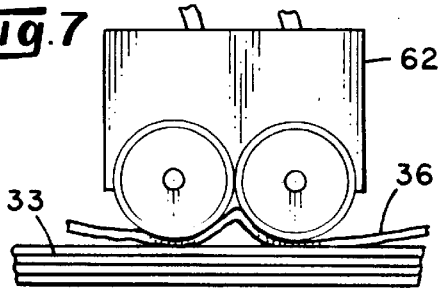

As best illustrated in FIGS. 4 and 5, the elevator system 54 includes a pair of vertically-arranged guide rods 60 fixedly secured to a bracket 59 having lower and upper ends 61 and 63, respectively, and the carriage 56 is mounted upon the guide rods 60 for vertical movement therealong. The pick-up head 50 includes a body 62 which is supported at the base of the carriage 56 and a pair of rollers 64, 66 which are rotatably attached to one side of the body 62. The rollers 64, 66 are mounted for rotation about parallel axes and have peripheral surfaces which are in contact with one another as shown in FIGS. 7 and 8. Preferably, the peripheral surfaces of the rollers 64, 66 are covered with a soft, rubberized material which facilitates the pick-up of a napkin 36 by the rollers 64, 66 in a manner described herein.

The pick-up head 50 also includes an air-powered actuator 68 (of known construction) supported on the side of the body 62 opposite the rollers 64, 66 and has a shaft which is connected to one roller 64 through the body 62. By appropriate actuation of the actuator 68, the one roller 64 is made to rotate in one rotational direction or the other rotational direction between two angular positions through a predetermined range of rotation (e.g. about ninety degrees). Stops (not shown) prevent rotation of the roller beyond prescribed rotational limits. To this end, the interior of the actuator 68 is adapted to receive air under pressure from a compressed air source 72 (FIG. 1) by way of a hose 70 so that the roller 64 is pressure-biased in one rotational direction toward one (i.e. a first) rotational limit of travel, and a spring (not shown) is mounted within the actuator body for spring-biasing the roller 64 in the opposite rotational direction toward the opposite (i.e. a second) rotational limit of travel. The air pressure from the source 72 is sufficient to overcome the biasing force of the spring so that the roller 64 is biased to the first rotational limit, and a relief valve is associated with the actuator for relieving the pressure within the actuator 68, when desired, so that the biasing force of the spring is permitted to rotate the roller 64 in the opposite rotational direction to the second rotational limit of travel. Since the peripheral surfaces of the rollers 64 and 66 are in contact with one another, the forced rotation of the one roller 64 effects the rotation of the other roller 66 in the opposite rotational direction.

When the pick-up head 50 is lowered upon the stack 33 of napkins 36 in the bin 34, the rollers 64, 66 are positioned in a first, or "ready", position as illustrated in FIG. 7. The actuator 68 is subsequently actuated so that the rollers 64, 66 rotate in the directions indicated by the arrows A in FIG. 7 to the second angular position and to thereby pinch the top napkin 36 of the stack 33 between the rollers 64, 66 as illustrated in FIG. 8. When the pick-up head 50 is subsequently moved to a location disposed above the worktable 24, the rollers 64, 66 are rotated in the direction opposite the FIG. 7 arrows A to release the napkin 36 from between the rollers 64, 66.

With reference again to FIGS. 3–5, the transport means 52 includes air-powered means, generally indicated 74, for moving the vertically-movable carriage 56 along the guide rods 60 between its lower limit of travel (at which the rollers 64, 66 rest in contact with the top napkin 36 of the stack 33) and an upper limit of travel at which the pick-up head 50 can be moved across the worktable 24 without interference therefrom. To this end, the air powered means 74 includes a vertically-arranged double-acting air cylinder assembly 76 which is connected between the guide rods 60 and the carriage 56 for acting therebetween. More specifically, the cylinder assembly 76 includes a vertically-arranged cylinder 78 which is connected to the lower end 61 of the bracket 59 so as to remain stationary with respect to the guide rods 60 and a ram 80 which is slidably mounted within the cylinder 78 and fixedly secured to the carriage 56. By actuating the cylinder assembly 76 with pressurized air from the source 72 (FIG. 1), the carriage 56 is raised or lowered along the guide rods 60 between its lower (FIG. 4) and upper (FIG. 5) limits of travel.

The operation of a double-acting air cylinder assembly 76 is well known in the art so that a detailed description of its operation is not believed to be necessary. Suffice it to say that air from the FIG. 1 source 72 is delivered to each end of the cylinder 78 (by way of hoses 82) to pressurize each end thereof, and solenoid-actuated relief valves are associated with each end of the cylinder 78 to selectively relieve the internal pressure at the cylinder ends. Therefore, control over the movement of the ram 80 along the length of the cylinder 78 is had by controlling the actuation of the relief valves at each end of the cylinder 78. In other words, by selectively relieving the pressure within one end of the cylinder 78, the pressure of air contained within the opposite end of the cylinder urges the ram 80 toward the one end. For controlling the operation of the cylinder assembly 76 (as well as the sequence of operation of the apparatus components), the apparatus includes a command controller 92 (FIG. 1) which is mounted beneath the surface of the table 42, and the solenoid relief valves associated with the cylinder assembly 76 are operatively wired to the controller 92.

Therefore and with reference still to FIGS. 4 and 5, by relieving the air pressure contained within the upper end of the cylinder 78, the carriage 56 is raised by the air cylinder assembly 76 to the upper limit of travel, as depicted in FIG. 5. Conversely, by relieving the air pressure contained within the lower end of the cylinder 78, the carriage 56 is lowered by the air cylinder assembly 76 so that the pick-up head 50 is urged downwardly into contact with the napkin stack 33. Since the pick-up head 50 is biased into engagement with the napkin stack 33 as the cylinder assembly 76 moves the carriage 56 downwardly from the upper limit of travel, the rollers 64 and 66 are better able to pick up the top napkin upon appropriate actuation of the actuator 68 than would be the case if the pick-up head 50 were not biased downwardly. If desired, the body 62 of the pick-up head 50 can be biased downwardly from the underside of the carriage 56 with springs 67 which operate as shock-absorbing devices when the pick-up head is lowered onto the napkin stack 35.

Figure 9:
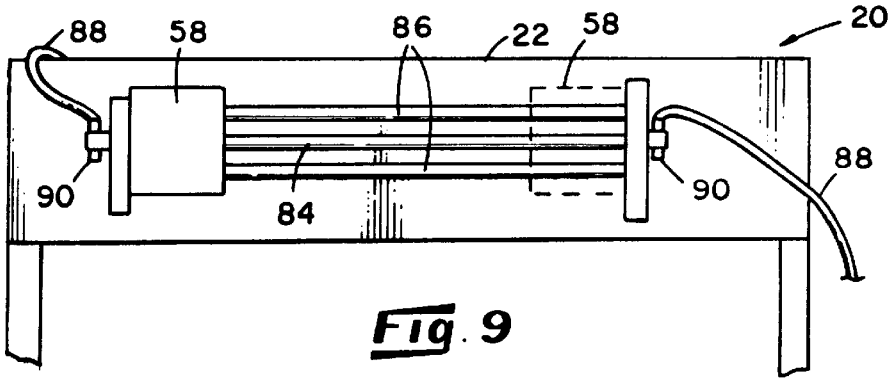
FIG. 9 is an elevational view of the guide rails along which the pick-up head traverses the worktable.
Figure 10:
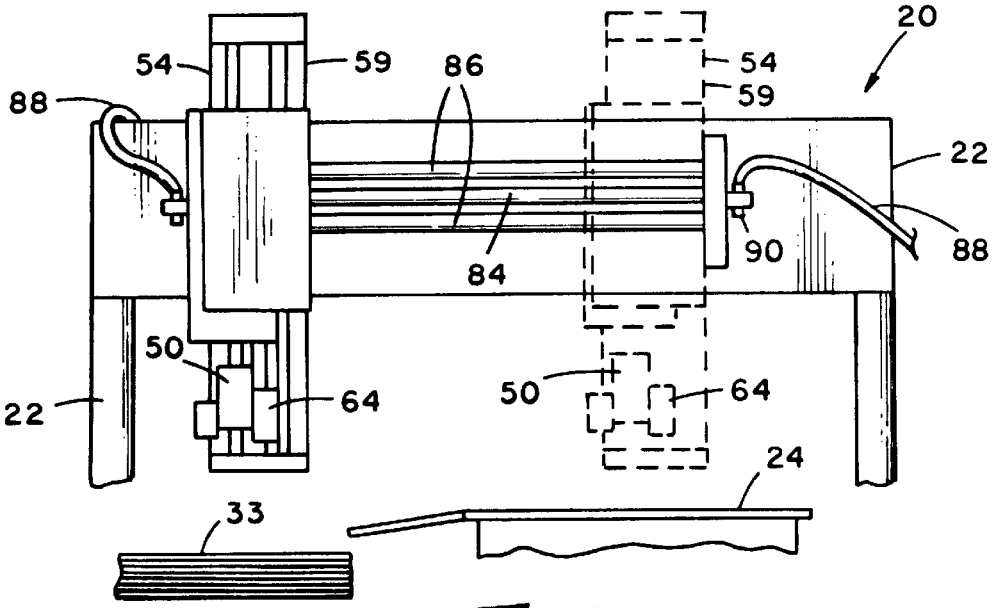
FIG. 10 is a view similar to that of FIG. 9 but showing the pick-up head being supported upon the FIG. 9 guide rails.
Figure 11:
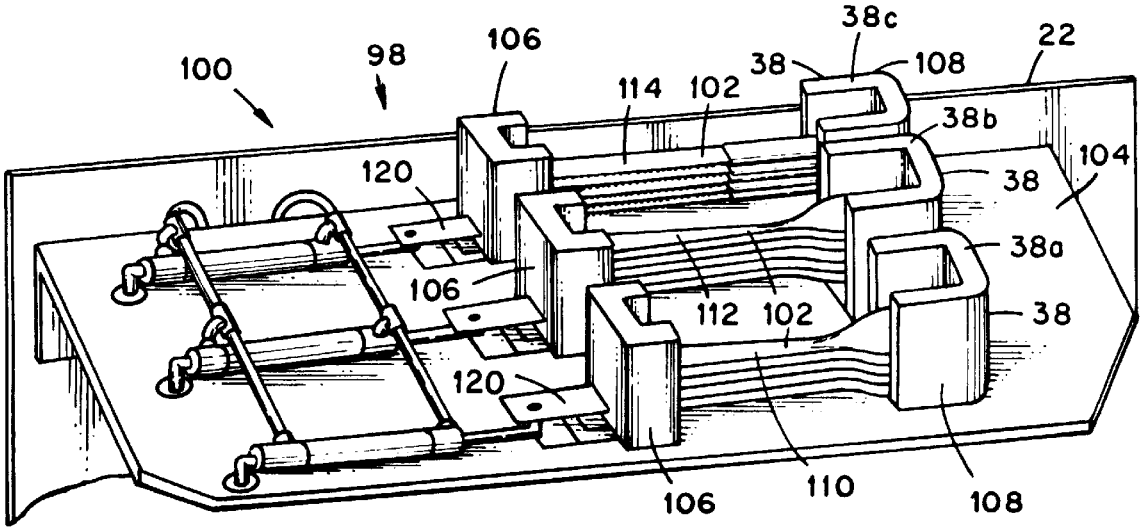
FIG. 11 is a perspective view of the silverware storage bins of the FIG. 1 apparatus within which silverware items are stored until wrapped.

With reference to FIGS. 9 and 10, the horizontally-movable carriage 58 is mounted upon a pair of horizontally-oriented guide rods 86 which, in turn, are supported by the frame 22. For securement of the elevator system 54 (FIGS. 3 and 10) to the horizontally-movable carriage 58, the bracket 59 upon which the guide rods 60 are supported is fixedly affixed in a stationary relationship to the horizontally-movable carriage 58 for movement therewith along the length of the guide rods 86.

For movement of the carriage 58 between the leftward end, as viewed in FIG. 10, and the rightward end of the guide rods 86, the transport means 52 includes a double-acting air cylinder assembly 84 which is positioned between the guide rods 86. The air is delivered to the opposite ends of the cylinder assembly 84 from the source 72 (FIG. 1) by means of hoses 88 (FIG. 9) and the piston of the cylinder assembly 84 is connected to the carriage 58 so that movement of the piston along the length of the cylinder assembly 84 moves the carriage 58 along the guide rods 86 by a corresponding amount. Solenoid-operated relief valves 90 are associated with the opposite ends of the cylinder assembly 84 so that by selectively relieving the air pressure within one end of the cylinder assembly 84, the carriage 58 is moved to either the rightward end or the leftward end of the guide rods 86. Operation of the relief valves 90, and thus the operation of the cylinder assembly 84, is controlled by the controller 92.

When the carriage 58 is positioned at the leftward end, as viewed in FIG. 9, of the guide rods 86, the elevator system 54 is located at the position depicted in solid lines in FIG. 10 at which the pick-up head 50 is disposed directly above the napkin stack 33. By comparison, when the carriage 58 is positioned at the rightward end, as viewed in FIG. 9, of the guide rods 86, the elevator system 54 is located at the position depicted in phantom in FIG. 10 so that the pick-up head 50 is disposed directly above the worktable 24. It follows that by moving the carriage 58 from the leftward end of the guide rods 86 to the rightward end thereof, a napkin 36 which is held in a pinched condition between the rollers 64, 66 of the pick-up head 50 is transported to a position above the worktable 24 at which release of the napkin from between the rollers 64, 66 permits the napkin to fall in a spread condition upon the worktable 24 and over the trough opening 28. By moving the carriage 58 from the rightward end, as viewed in FIG. 9, of the guide rods 86 to the leftward end of the guide rods 86, the pick-up head 50 is moved to a "ready" position at which it is situated directly above the napkin stack 33.

The operation of the napkin pick-up system 48 can be summarized as follows. At the outset of a napkin pick-up operation, the horizontally-movable carriage 58 is disposed at the leftward end, as viewed in FIG. 9, of the guide rods 86, the vertically-movable carriage 58 is disposed at the upper limit of travel, as viewed in FIG. 5, and the rollers 64, 66 of the pick-up head 50 are disposed in the "ready" (FIG. 7) angular position (relative to the body 62 of the head 50). Upon initiation of the pick-up operation, the carriage 58 is moved toward its lower limit of travel so that the rollers 64, 66 are urged downwardly against the top napkin 36 of the stack 33. At that point, the rollers 64, 66 are rotated by the actuator 68 of the pick-up head 50 through a prescribed angular amount so that the top napkin 36 is pinched between the rollers 64, 66. The carriage 58 is then raised to its FIG. 5 elevated position by way of the cylinder assembly 76, and then the carriage 58 is thereafter moved to its rightward (as seen in FIG. 9) position along the length of the guide rods 86 by way of the cylinder assembly 84 so that the pick-up head 50 is positioned directly over the worktable 24 as illustrated in FIG. 10.

Therefore, by positioning the pick-up head 50 upon the napkin stack 33, actuating the actuator 68 so that the top napkin 36 is pinched between the rollers 64, 66 of the pick-up head 50, raising the vertically-movable carriage 56 along the guide rods 60 to the upper limit of travel and then moving the horizontally-movable carriage 58 along the guide rods 86 to the rightwardmost (FIG. 9) limit of travel, the napkin 36 which is held by the pick-up head 50 is positioned directly above the worktable 24. By actuating the actuator 68 so that the napkin 36 is released by the pick-up head 50, the napkin 36 is dropped to the surface of the worktable 24. Following the release of the napkin 36 from the pick-up head 50, the horizontally-movable carriage 58 is returned to the leftwardmost (as seen in FIG. 9) limit of travel and the vertically-movable carriage 56 is lowered until the rollers 64, 66 of the pick-up head 50 are returned into contact with the top napkin of the stack 33.

It follows that in order for a napkin 36 to drop to a desired position upon the worktable 24 when released from the rollers 64, 66, the transport means 52 and, in particular, its guide rods 86, are appropriately disposed in relation to the worktable 24 so that when the carriage 58 is moved to the leftward end of the guide rods, as shown in FIG. 9, the pick-up head 50 is disposed directly above the worktable.

With reference again to FIG. 3, there is illustrated in phantom a napkin 36 which has been dropped over the worktable 24 by the pick-up head 50. The napkin 36 includes edge sections 94 and a central section 95 which is bordered by the edge sections 94, and the napkin 36 is positioned over the trough 32 so that the central section 95 spas the width of the trough opening 28. With the napkin 36 positioned across the trough opening 28 in this manner, the upper surface of the napkin 36 is in a desired position for accepting silverware items dropped thereupon in a manner described herein.

With reference to FIGS. 11–16, there is illustrated the means, generally indicated 100, of the apparatus 20 for delivering items of silverware 102 (FIG. 11) from the silverware storage bins 38 to the trough 32 of the worktable 24. To this end, the delivery system 100 includes a movable tray system 96 for moving silverware items 102 from a location beneath the bins 38 to the trough 32 and a dispensing system 98 for dispensing silverware items 102 onto the tray system 96 from the bins 38. Associated with the bins 38 is a horizontal platform 104 which is supported by the apparatus frame 22 in an elevated condition above the worktable 24 and to one side of (or toward the right side as viewed in FIGS. 14 and 15) the trough 32. Each bin 38 includes two end pieces 106, 108 (best shown in FIG. 11) which are fixedly secured upon the platform 104 and which are notched to accept a corresponding end of a plurality of silverware items 102 placed therein in a stacked relationship. More specifically, one bin, indicated 38*a*, is adapted to hold a stack of spoons 110, a second bin, indicated 38*b*, is adapted to hold a stack of forks 112, and a third bin, indicated 38*c*, is adapted to hold a stack of knives 114.

Figure 12:
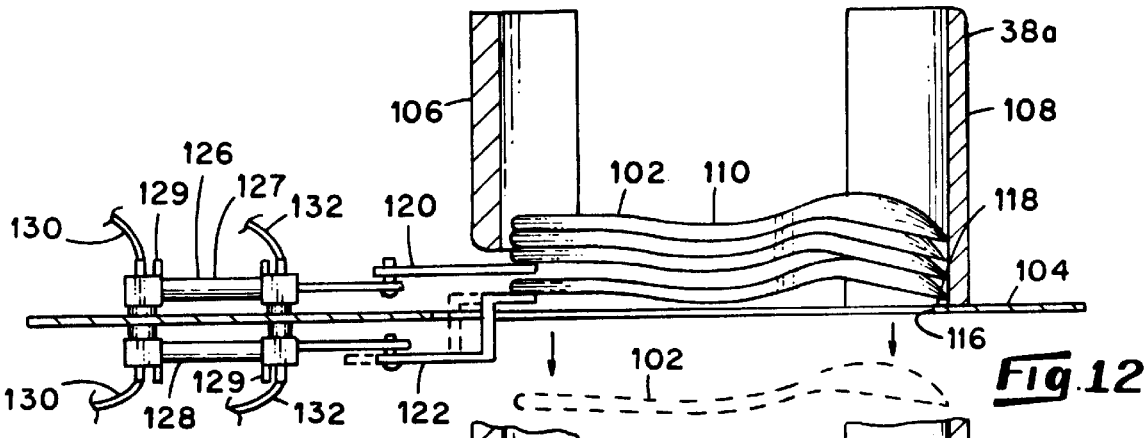
FIGS. 12 and 13 are elevational views, shown partially in section, of one of the silverware bins of FIG. 11 and the means with which a single silverware item is dispensed from the bin for wrapping.
Figure 13:
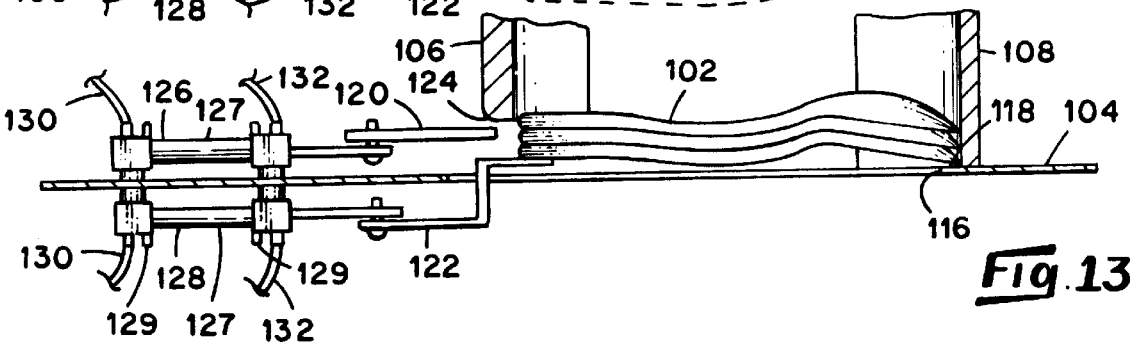

As exemplified by the bin 38*a* of FIGS. 12 and 13, each bin 38 is disposed above an opening 116 provided in the platform 104 through which a silverware item 102 is permitted to fall during a silverware dispensing operation of the apparatus 20. To this end, a lip 118 is defined in each bin 38 adjacent the end piece 108, and a pair of laterally-moving upper and lower plungers 120, 122, respectively, are mounted in each bin 38 adjacent the opposite end piece 106 for holding the silverware items 102 above the platform opening 116. The plungers 120, 122 are moveable leftwardly and rightwardly (as viewed in FIGS. 12 and 13) through a cutout 124 provided in the lower end of the end piece 106.

The movement of the plungers 120, 122 is controlled by way of a pair of air-actuated double-acting air cylinder assemblies 126, 128 whose cylinders 127 are fixed in a stationary condition against the upper and lower surfaces of the platform 104 and whose pistons are attached to the corresponding plunger 120 or 122. Air is supplied to each end of the cylinder assemblies 126, 128 by way of hoses 130, 132, and solenoid-actuated relief valves 129 are associated with the ends of the cylinder assemblies 126 or 128 for relieving, as necessary, the air pressure within one end of the cylinder assembly 126 or 128. It follows that by relieving the pressure on the right end, as viewed in FIG. 12 and 13, of a cylinder assembly 126 or 128, the corresponding plunger 120 or 122 is urged leftwardly, and by relieving the pressure on the left end, as viewed in FIGS. 12 and 13, of a cylinder assembly 126 or 128, the corresponding plunger 120 or 122 is urged rightwardly. Control of the actuation of the relief valves 129, and thus the silverware-dispensing operation, is had by way of the command controller 92 of FIG. 1.

At the outset of a silverware-dispensing operation, both of the plungers 120, 122 are positioned in the solid-line position illustrated in FIGS. 12 and 13 so that the lower plunger 122 supports an end of the shank of single (i.e. the lowermost) silverware item 102 while the upper plunger 120 supports an end of the shanks of the remaining silverware items 102 in the stack. (The opposite ends of the silverware items are positioned upon the lip 118 so that the silverware items are prevented from falling through the platform opening 116 by either the lip 118 and lower plunger 122 or by either the lip 118 and upper plunger 120.) To dispense the lowermost silverware item 102 from the bin 38 (and with reference still to FIGS. 12 and 13), the cylinder assembly 128 is appropriately actuated so that the plunger 122 is shifted leftwardly from the solid-line position of FIG. 12 to the position illustrated in phantom in FIG. 12 so that the silverware item 102 is permitted to fall downwardly through the opening 116 to the movable tray system 96 described herein.

Following the release of the lowermost silverware item 102 through the opening 116, the lower plunger 122 is returned to the FIG. 12 solid-line position, and the cylinder assembly 126 is appropriately actuated so that the upper plunger 120 is shifted leftwardly from its position illustrated in FIG. 12 to its position illustrated in FIG. 13 so that the remainder of the stack of silverware items 102 is permitted to drop and come to rest upon the lower plunger 122. The upper plunger 120 is subsequently returned to its FIG. 12 (rightward) position to separate and support the left end of the remainder of the stack of silverware items 102 from the lowermost silverware item 102 in preparation of a subsequent silverware-dispensing operation. It follows that the plungers 120 and 122 are vertically spaced from one another by a distance which is slightly greater that the thickness of the shank of the silverware item 102 supported by the plungers 120, 122 so that upon return of the upper plunger 120 to the FIG. 12 position, the shanks of the silverware items situated above the lowermost item are forced upwardly to the position illustrated in FIG. 12. The control of the actuation of the cylinder assemblies 126, 128 is had by way of the controller 92 (FIG. 1) which is appropriately wired to the relief valves 129. Within the apparatus 20 and as will be apparent herein, one silverware item 102 is dropped from each bin 38 onto the tray system 96 at the same moment that the silverware items in every other bin 38 is dropped onto the tray system 96.

Figure 14:
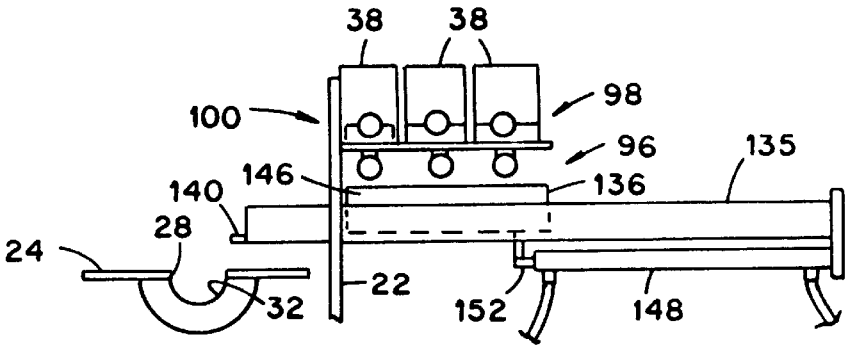
FIGS. 14 and 15 are side elevational views of the silverware delivery system of the apparatus for transporting items of silverware from the storage bins to the worktable.
Figure 15:
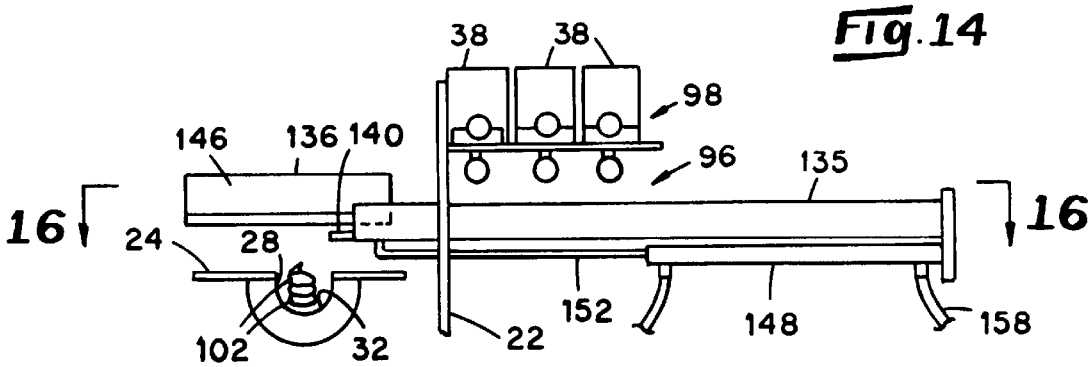
Figure 16:
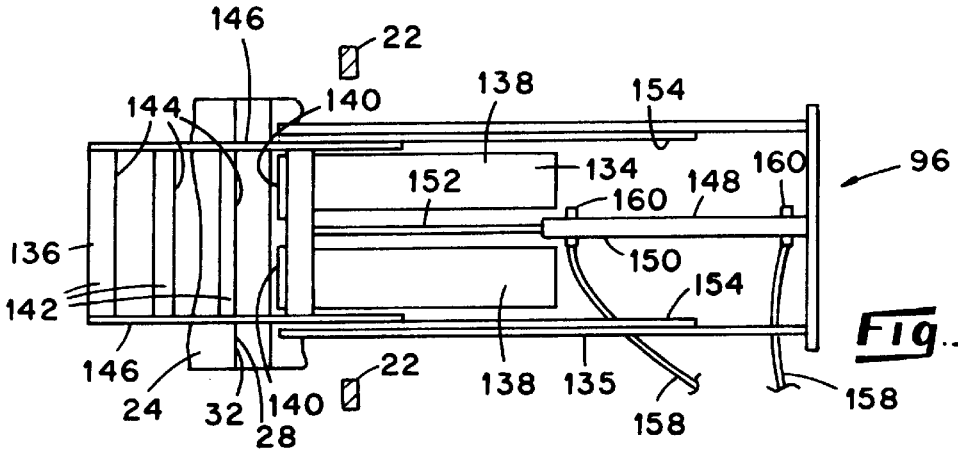
FIG. 16 is a cross sectional view taken about along line 16—16 of FIG. 15 showing a plan view of the delivery system of FIGS. 14 and 15.
Figure 17:
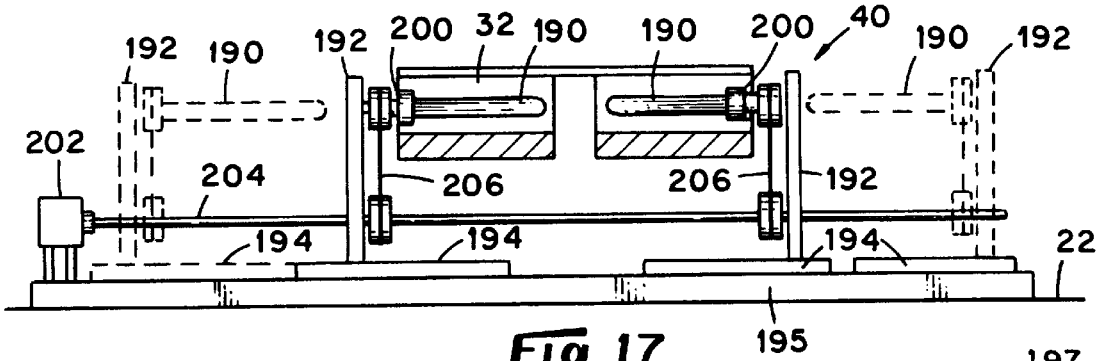
FIG. 17 is a longitudinal cross-sectional view of the apparatus worktable and napkin-spinning means as seen along line 17—17 of FIG. 3.
Figure 18:
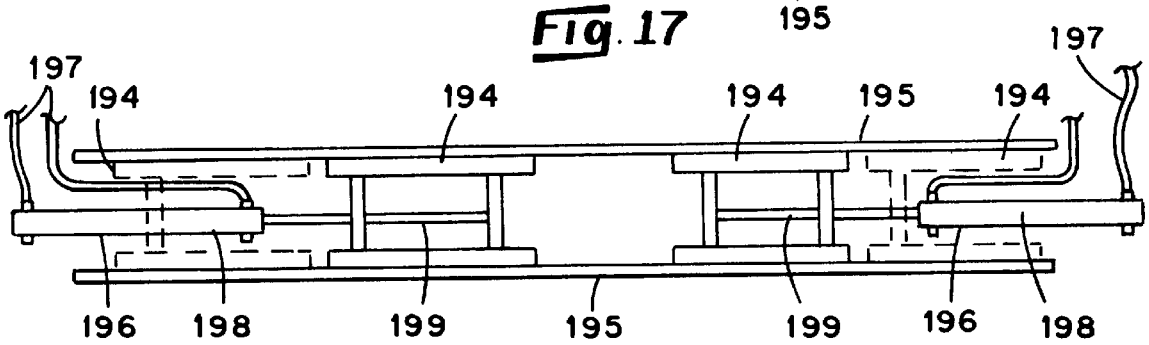
FIG. 18 is a plan view of the wrapping system as seen from below in FIG. 17.

With reference to FIGS. 14–16, the movable tray system 96 includes means providing a horizontally-mounted shelf 134 which is supported by the apparatus frame 22 in a stationary condition with respect thereto and a rack 136 which is movably supported upon the shelf 134 for sliding movement relative thereto between two limits of travel (i.e. rightward and leftward limits as viewed in FIGS. 14 and 15). The shelf 134 is provided by a pair of platen members 138 which are supported in spaced relationship by way of a frame 135 attached intermediate the frame 22 and the platen members 138 as illustrated in FIG. 16 and have portions which extend from locations situated directly beneath the silverware bins 38 to edges 140 which terminate at a location adjacent the opening 28 of the worktable trough 32. The rack 136 includes a plurality (i.e. four) receptacle-providing members 142 which are fixedly joined to one another by way of a side members 146 for movement together along the shelf 134, and the receptacle members 142 are spaced from one another to provide vertically-disposed through-openings 144 therebetween. The through-openings 144 of the rack 136 are disposed in such a relation to one another and to the openings 116 provided beneath the silverware bins 38 so that when the rack 136 is positioned at one, or a first, limit of travel, i.e. its position illustrated in FIG. 14 at which the rack 136 is disposed directly beneath the silverware bin 38, each of the through-openings 144 is in vertical registry with the bin openings 116. Therefore, when the rack 136 is in its first, or FIG. 14, position and silverware items 102 are simultaneously dropped from the bins 38, the silverware items 102 come to rest upon the surface of the shelf 134 in a confined, or captured, condition within the through-openings 144 of the rack 136. When the rack 136 is subsequently moved from the FIG. 14 position to the second limit of travel, i.e. the position illustrated in FIG. 15, the silverware items 102 captured within the receptacle members 144 drop into the worktable trough 32 as each silverware item moves off of the shelf 134.

For purposes of moving the rack 136 between the positions illustrated in FIGS. 14 and 15, there is provided within the opposite sides of the frame 135 a pair of guide channels 154 (FIG. 16) within which the rack side members 146 are slidably received, and the apparatus 20 includes an air-actuated double-acting cylinder assembly 148 which is connected between the frame 135 and the rack 136. In particular, the cylinder assembly 148 includes a cylinder 150 which is fixedly secured to the frame 135 and a piston ram 152 which is fixedly secured to one of the receptacle members 142 so that as the piston ram 152 is moved along the length of the cylinder 150, the rack 136 is moved along the length of the frame 135. Air, under pressure, is conducted to the opposite ends of the cylinder 150 by way of hoses 158, and solenoid-actuated relief valves 160 are associated with the opposite ends of the cylinder 150 so that by relieving the air pressure within a selected end of the cylinder 150, the piston ram 152 is forced toward the selected cylinder end by the air pressure contained within the opposite cylinder end.

The operation of the movable tray system 96 can be summarized as follows. At the outset of a silverware dispensing operation, the rack 136 is situated below the silverware storage bins 38 so that the through-openings 144 of the rack 136 are positioned in vertical registry with the bin openings 116. At the appropriated stage of the apparatus operation, the cylinder assemblies 128 of the silverware-dispensing means 100 are actuated so that a single item of silverware 102 is dropped from each bin 38. Of course, with the rack through-openings 144 being disposed in vertical registry with the bin openings 116, each of the dropped silverware items 102 fall into a corresponding one of the rack through-openings 144 and onto the surface of the shelf 134. The rack 136 is subsequently moved toward the worktable 24 along the frame channels 154 so that the silverware items are moved toward the edge 140 of the shelf 134. The rack 136 continues to move across the edge 140 of the shelf 134 so that each silverware item 102 positioned within the rack through-openings 144 is pushed off the shelf edge 140 and onto the worktable 24. Within the apparatus 20, the silverware items are dispensed into the rack through-openings 144 so that a knife 114 is positioned closest to the shelf edge 140, so that a fork 112 is positioned second-closest to the shelf edge 140, and so that a spoon 110 is positioned farthest from the shelf edge 140. Consequently, the movement of the rack 136 across the shelf edge 140 effects the fall of the silverware items onto the worktable 24 in a predetermined order, i.e. the knife first, the fork second and then the spoon third.

Figure 3:
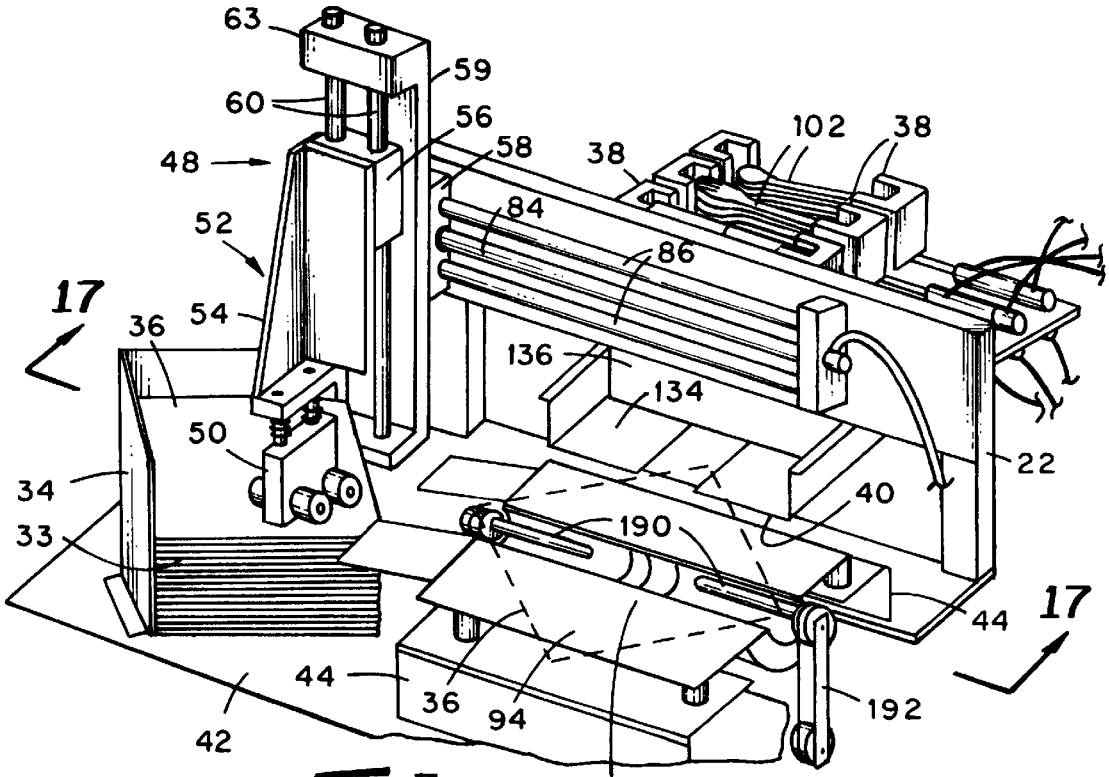
FIG. 3 is a fragmentary perspective view of the FIG. 1 embodiment.
Figure 21:
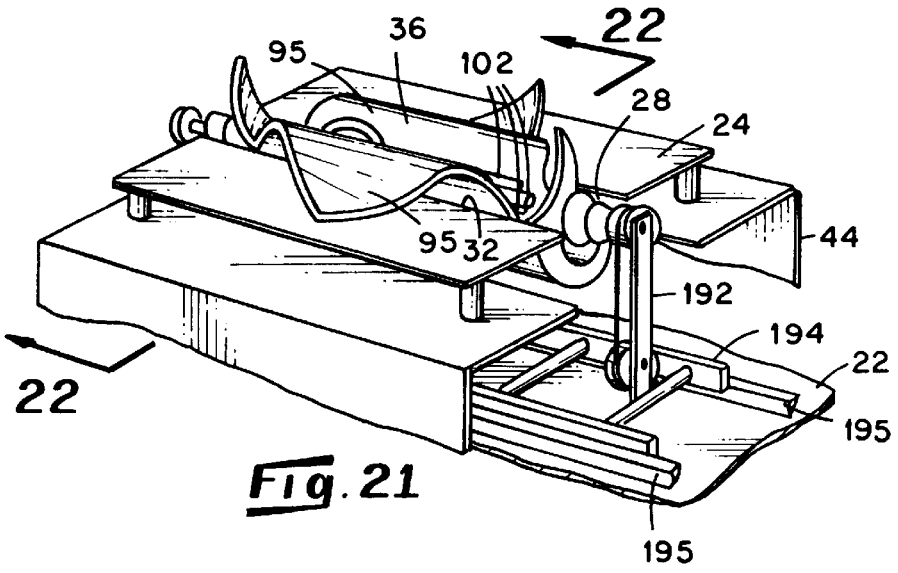
FIG. 21 is a fragmentary perspective view of the apparatus worktable within which a napkin and silverware items are positioned for wrapping.

As will be apparent herein, by the time that the silverware items 102 are dropped onto the worktable 24, a napkin 36 has been placed over the opening 28 of the trough 32 as shown in phantom in FIG. 3. Consequently, as silverware items are dropped off the edge 140 of the shelf 136, the silverware items strike the central section 95 of the napkin 36 so that the napkin 36 is urged downwardly (under the weight of the silverware items) into the bottom of the trough 32 to the condition illustrated in FIGS. 21 and 22 so that the central section 95 of the napkin 36 is positioned between the silverware items 102 which rest upon the napkin 36 and the bottom of the trough 32. Following the acceptance of the silverware items 102 and napkin 36 by the trough 32, the napkin 36 is wrapped about the silverware items by the napkin-spinning means 40 described herein.

Figure 22:
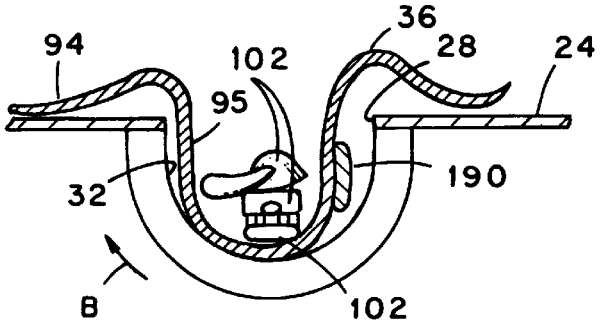
FIG. 22 is a cross-sectional view taken about along line 22—22 of FIG. 21 illustrating the relative disposition of the silverware items and napkin and the wrapping blades at the outset of a wrapping operation.

With reference to FIGS. 17–20, the apparatus means, indicated 40, for spinning a napkin 36 about silverware items 102 positioned within the trough 32 includes a pair of rotatable blades 190 arranged in an end-to-end relationship and adapted to move into and out of the open ends of the trough 32 (i.e. between the positions illustrated in solid lines in FIG. 17 and the positions illustrated in phantom in FIG. 17) for acting upon a napkin 36 and silverware 102 positioned therein. In this connection, each blade 190 is rotatably mounted upon a pedestal 192 which, in turn, is mounted upon a movable carriage 194. The carriage 194 is slidably mounted upon a pair of parallel guideways 195 which are fixedly attached to the apparatus frame 22 and disposed beneath the worktable 24. A double-acting air cylinder assembly 196 (which receives air, under pressure from the compressed air source 72 through hoses 197) has a cylinder 198 which is attached to the frame 22 in a stationary condition with respect thereto and adjacent the guideways 195 and has a piston ram 199 which is connected to the carriage 194 so that appropriate actuation of the cylinder assembly 196 (by relieving air pressure through a relief valve mounted on a corresponding end of the cylinder assembly 196) moves the carriage 192 leftwardly or rightwardly as viewed in FIG. 17 between a withdrawn position (at which the blade 190 is positioned outboard of the trough 32) and an operating, or "ready", position at which the blade 190 is disposed within and adjacent one side of the trough 32 as shown in FIG. 22. Again, control over the actuation of the cylinder assemblies 196, and thus the position of the blades 190 along the length of the trough 32, is had by way of the controller 92 (FIG. 1) which is appropriately wired to the relief valves mounted at each end of the cylinder assemblies 196. As will be apparent herein, when the blades 190 are moved into and out of the trough 32, they are moved in unison with one another.

Figure 19:
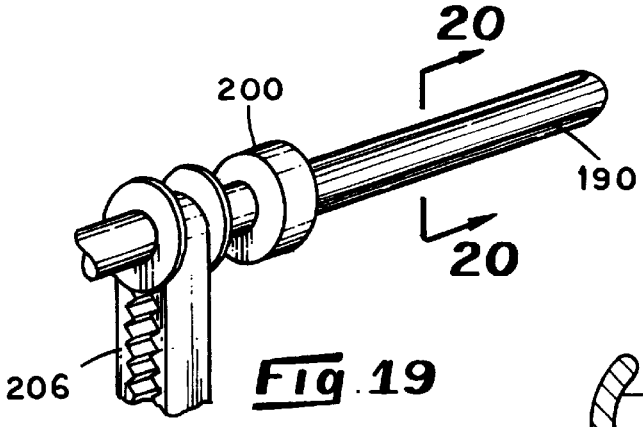
FIG. 19 is a perspective view of one of the blades of the wrapping system of the FIG. 1 apparatus.
Figure 20:
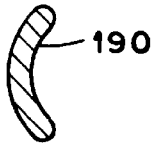
FIG. 20 is a cross-sectional view taken about along line 20—20 of FIG. 19.

During operation of the napkin-spinning means 40, a napkin 36 is wrapped about silverware positioned within the trough 32 as the blades 190 (which are spaced from the longitudinal axis of the trough 32) are rotated about the longitudinal axis of the trough 32. To this end and as best shown in FIG. 19, each blade 190 is supported by a base 200, which in turn is rotatably supported upon the pedestal 192 (FIG. 17), and a servomotor 202 (FIG. 17) is attached to the base 200 by way of a shaft 204 and belt 206 so that rotation of the motor shaft 204 effects the rotation of both blades 190 about the longitudinal axes of the trough 32. Thus, the blades 190 are slaved to one another in that rotation of one blade 190 effects the rotation of the other blade 190. The operation of the servomotor 202 is controlled by way of the controller 92 so that upon cessation of a napkin-spinning operation, the blades 190 halt at the position on the side of the trough at which a blade-spinning operation is initiated. This way, the blades 190 are in the appropriate position relative to the interior of the trough 32 in preparation of a subsequent napkin-spinning operation.

Figure 23:
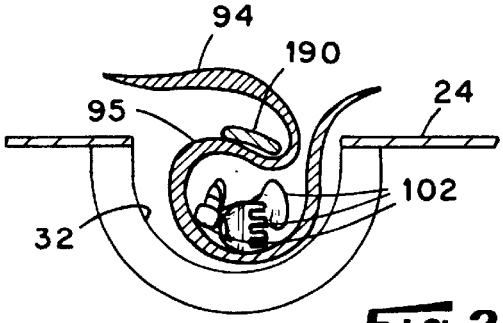
FIGS. 23 and 24 are views similar to that of FIG. 22 illustrating the relative disposition of the FIG. 22 items during stages of the wrapping operation.
Figure 24:
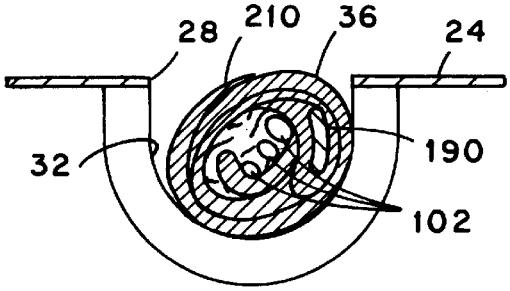
Figure 25:
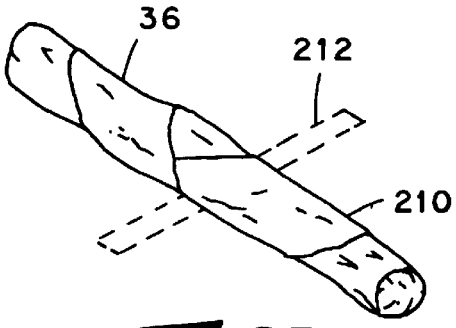
FIG. 25 is a perspective view of a wrapped napkin/silverware arrangement which has been wrapped by the FIG. 1 apparatus.

With reference to FIGS. 22–24, there is shown various positions of the napkin 36 and silverware items 102 as the blades 190 are rotated within the trough 32. For example, before a napkin-spinning operation is initiated, the blades 190 are disposed to one side of the trough 32 as illustrated in FIG. 22 and the silverware items rest upon the central section 95 of the napkin 36 in the bottom of the trough 32. Upon initiation of the napkin-spinning operation, the blades 190 are rotated in the direction of the arrow B in FIG. 22 about the longitudinal axis of the trough 32 so that the napkin 36 and silverware items 102 are forced to rotate within the trough 32. For example, during the first revolution of the blades 190 within the trough 32, the blades 190 spin the napkin 36 and silverware items 102 so that the edge sections 94 of the napkin are pulled toward the trough 32 as shown in FIG. 23. The blade 190 continues to spin the napkin 36 and silverware items 102 (through, for example, three complete revolutions of the blade 190) until the entirety of the napkin 36 is pulled within the trough 32 and wound about the silverware items into a wrapped arrangement, indicated 210 in FIGS. 24 and 25. In the FIG. 24 condition, the blades 190 are halted in the position assumed at the outset of the napkin-spinning operation and are wound within the wrapped arrangement 190. However, to remove the blades 190 from the wrapped arrangement 210, the cylinders assemblies 196 are actuated to move the blades 190 along a path parallel to the longitudinal axis of the trough 32 and thereby withdraw the blades 190 from arrangement 210. The wrapped arrangement 210 thus remains within the bottom of the trough 32 where it can be automatically banded with a band 212 depicted in FIG. 25 and ejected (or otherwise removed) from the trough 32 in preparation of a subsequent napkin-wrapping operation.

The operation of the apparatus 20 can best be understood as the sequence of operation of the various components of the apparatus 20 is described. In particular, at the outset of a napkin-wrapping operation, the blades 190 are disposed in the FIG. 17 solid-line, or "ready" position within the trough 32, the rack 136 of the movable tray system 96 is disposed beneath the bins 38 so that the rack through-openings 144 are positioned in vertical registry with the bin openings 116, and the napkin pick-up head 150 is positioned in the FIG. 5 "ready" position above the napkin stack 33. The silverware bins 38 are filled with a plurality of silverware items 102 in a stacked relationship, and the lowermost item 102 in each stack within the bin 38 is supported above the opening 116 by the lower plunger 122 and the lip 118 disposed at the opposite end of the bin opening 116. When the wrapping-operation is initiated by, for example manually touching a "start" switch 214 (FIG. 1) associated with the controller 92, the napkin pick-up system 48 is initiated so that a napkin 36 is picked up by means of the napkin pick-up system 48 and moved from the top of the napkin stack 33 to the trough 32 where the napkin 36 is released over the trough 32. Upon return of the pick-up head 50 and carriage 58 to the FIG. 5 "ready" position situated above the napkin stack 33 following the release of a napkin 36 over the worktable 24, the silverware items 102 are dispensed from the storage bin 38 and delivered to the worktable 24 by way of the movable tray system 96. As mentioned earlier, the weight of the silverware items 102 which fall upon the napkin 36 positioned over the trough 32 push the central section 95 of the napkin 36 into the trough 32 so that the silverware items 102 come to rest within the trough 32 with the central section 95 of the napkin 36 positioned between the silverware items 102 and the bottom of the trough 32. The napkin-spinning operation is thereafter initiated to rotate the blades 190 and thereby wrap the napkin 36 about the silverware items 102 into a wound arrangement 210. Upon completion of the napkin-spinning operation, the blades 190 are withdrawn from the trough 32 to facilitate removal of the wrapped arrangement 210 from the trough 32. If desired, a banding and ejection system can be incorporated within the worktable 24 so that the wound arrangement 210 is automatically banded while in the trough 32 and thereafter mechanically ejected from the trough 32 in preparation of a subsequent napkin-wrapping operation.

As mentioned above, the control of the operation of the apparatus 20 is had by controlling the sequencing of operation of the various components of the apparatus 20. To this end, the controller 92 (FIG. 1) includes an internal control computer and associated electronic components which are appropriately wired to the relief valves of the double-acting cylinders of the apparatus 20 for opening and closing the relief valves, when appropriate, to ensure that the operations of the various components are carried out in the proper sequence and actuates, when appropriate, the servomotor 202 of the napkin-spinning means 40. Therefore and for example, the silverware items 102 would be delivered to the trough 32 only after the napkin pick-up head 150 has delivered a napkin 36 to the worktable 24 and returned to its FIG. 5 "ready" position above the napkin stack 33, and the blades 190 would not be returned to a "ready" position within the trough 32 from the retracted position until the previously-wound napkin/silverware arrangement 210 has been removed from the trough 32.

It will be understood that numerous modifications and substitutions can be had to the aforedescribed embodiment without departing from the spirit of the invention. For example, although the aforedescribed apparatus 20 has been shown and described as including carriages that are slidably movable along guide rods or guideways in response to the actuation of double-acting air cylinder assemblies, the carriages employed in the apparatus 20 can, in the alternative, employ wheels for rolling movement of the carriages along guide rails and could be powered along the guide rails by electrically-powered motors which are connected in driving relationship with the wheels of the carriages. Accordingly, the aforedescribed embodiment is intended for the purpose of illustration and not as limitation.

We claim:

1. An apparatus for wrapping a napkin about an item of silverware comprising:

a frame;

means supported by the frame defining an elongated, substantially horizontally-disposed trough having a bottom and an upwardly-directed opening for accepting a napkin and an item of silverware in preparation of a napkin-wrapping operation so that when a napkin and an item of silverware are accepted by the trough, the napkin is disposed between the item of silverware and the bottom of the trough;

an elongated blade supported by the frame within the trough and oriented substantially parallel to the longitudinal axis of the trough;

means connected to the frame for rotating the blade about the longitudinal axis of the trough so that following acceptance of a napkin and an item of silverware by the trough as aforesaid, the blade can be rotated about the longitudinal axis of the trough to wrap the napkin about the silverware item into a wrapped arrangement.

2. The apparatus as defined in claim 1 wherein the trough has at least one open end, and the apparatus further comprises means attached to the frame for withdrawing the blade along the longitudinal axis of the trough through the open end thereof so that upon completion of a napkin-wrapping operation, the blade can be withdrawn from the wrapped arrangement to facilitate the removal of the wrapped arrangement from the trough.

3. The apparatus as defined in claim 1 wherein the trough has two open ends, the elongated blade is a first elongated blade, and the apparatus further includes:

a second elongated blade supported by the frame and within the trough and oriented substantially parallel to the longitudinal axis of the trough, the first and second elongated blades being arranged in an end-to-end relationship within the trough, and the means for rotating is adapted to rotate the second elongated blade about the longitudinal axis of the trough in conjunction with the rotation of the first blade so that following acceptance of the napkin and the item of silverware by the trough as aforesaid, both the first and second blades can be rotated about the longitudinal axis of the trough to wrap the napkin about the silverware item; and means for withdrawing the first and second blades along the longitudinal axis of the trough through the open ends thereof so that upon completion of a napkin-wrapping operation, the blades can be withdrawn from the wrapped arrangement to facilitate the removal of the wrapped arrangement from the trough.

4. The apparatus as defined in claim 3 further comprising means for supporting the first and second blades for movement longitudinally of the trough, and means associated with the blade-supporting means for moving the blades longitudinally of the trough between an operating position at which the blades are positioned adjacent the napkin and the silverware item for spinning the napkin and silverware item within the trough when rotated by the blade-rotating means and a retracted position at which the blades are withdrawn from the operating position so that following a napkin-wrapping operation, the blades can be withdrawn from the wrapped arrangement through the open ends of the trough to facilitate removal of the wrapped arrangement from the trough.

5. The apparatus as defined in claim 1 further comprising:

a napkin storage bin for containing a stack of napkins to be wrapped about silverware with the apparatus; and a pick-up system for automatically moving a napkin from the napkin storage bin to the trough for use in a napkin-wrapping operation.

6. The apparatus as defined in claim 5 wherein the pick-up system includes a pick-up head for picking up and subsequently releasing the top napkin from a stack of napkins in the napkin storage bin and means for transporting the pick-up head from the storage bin to the trough so that by picking up the top napkin from the stack with the pick-up head, transporting the pick-up head with the top napkin held thereby to the trough, and then releasing the held napkin from the pick-up head, the napkin is permitted to fall onto the trough and into a spread condition over the trough opening.

7. The apparatus as defined in claim 6 wherein the pick-up head includes a body and a pair of rollers rotatably mounted upon the body for engaging the top napkin of a stack of napkins, and the means for picking up the top napkin from the stack includes means for rotating the rollers relative to the body so that by rotating the rollers in a predetermined rotational direction, the top napkin is pinched and thereby held between the rollers and so that rotating the rollers in the opposite rotational directions, the napkin is released from between the rollers.

8. The apparatus as defined in claim 7 wherein the pair of rollers are mounted upon the body for rotation about parallel axes and have peripheral surfaces which are in contact with one another, and the means for rotating the rollers includes an airpowered actuator.

9. The apparatus as defined in claim 5 wherein the pick-up system includes a vertically-oriented guideway upon which the pick-up head is mounted to accommodate vertical movement of the pick-up head along the vertically-oriented guideway between a lowered condition at which the pick-up head is permitted to pick up the top napkin from a stack of napkins contained within the napkin storage bin and a raised condition at which the pick-up head is elevated above the napkin stack;

means for moving the pick-up head between the lowered and raised conditions;

a horizontally-oriented guideway upon which the vertically-oriented guideway is mounted to accommodate horizontal movement of the vertically-oriented guideway along the horizontally-oriented guideway between a first position located adjacent the napkin storage bin and a second position located adjacent the trough; and means for moving the vertically-oriented guideway along the horizontally-oriented guideway between the first and second positions so that after the pick-up head is utilized to pick up a napkin from the napkin storage bin and is moved to its raised condition, the pick-up head and napkin held thereby can be moved from the first location to the second position adjacent the trough for release of the napkin by the pick-up head.

10. The apparatus as defined in claim 1 further comprising:

a silverware storage bin supported by the frame in an elevated condition with respect to the trough for containing a stack of silverware items to be wrapped with the apparatus; and a silverware delivery system supported by the frame for automatically delivering an item of silverware from the silverware storage bin to the trough.

11. The apparatus as defined in claim 10 wherein the silverware delivery system includes means for dispensing a single item of silverware from the stack of silverware for delivery to the worktable.

12. The apparatus as defined in claim 11 wherein the silverware storage bin includes means for holding a plurality of silverware items in a vertically-stacked relationship and has a bottom including an opening disposed below the silverware items, and the means for dispensing is adapted to permit the lowermost silverware item to drop through the bottom opening.

13. The apparatus as defined in claim 12 wherein the means for dispensing includes a movable rack adapted to accept a silverware item dropped therein through the bottom opening and wherein the rack is supported for movement by the frame between a first location disposed generally beneath the silverware storage bin and a second location disposed adjacent the trough and further includes means for moving the rack between the first and second positions so that a silverware item which is dropped from the silverware storage bin into the rack is transported to the trough by way of the movable rack.

14. An apparatus for wrapping a napkin about an item of silverware wherein the napkin has edge sections and a central section which is bounded by the edge sections, the apparatus comprising:

a frame;

means supported by the frame defining an elongated, substantially horizontally-disposed trough having a bottom, two opposite sides and an upwardly-directed opening for accepting a napkin and an item of silverware positioned within the trough in preparation of a napkin-wrapping operation;

means attached to the frame for moving a napkin from a supply of napkins to a spread condition over the trough at which the central section of the napkin spans the width of the upwardly-directed opening of the trough;

means joined to the frame for delivering an item of silverware from a supply of silverware items onto the napkin spread over the trough so that the delivered item of silverware falls into the trough with the napkin so that the central section of the napkin is positioned between the delivered item of silverware and the bottom of the tough; and means associated with the trough for spinning the napkin and silverware item positioned within the trough so that the napkin is wound about the silverware item into a wrapped arrangement, wherein the means for spinning includes an elongated blade positioned within the trough and adjacent one side thereof, means for supporting the blade for rotation about the longitudinal axis of the trough, and means for rotating the blade about the longitudinal axis of the trough so that when rotated by the blade within the trough, the napkin is wound about the silverware item into a wrapped arrangement.

15. The apparatus as defined in claim 14 further comprising means associated with the frame for moving the blade longitudinally of the trough so that following the wrapping of the napkin about the silverware item into a wrapped arrangement, the blade can be withdrawn from the wrapped arrangement to facilitate the removal of the wrapped arrangement from the trough.

16. A method for wrapping a napkin about an item of silverware wherein the napkin has edge sections and a central section which is bounded by the edge sections, the method comprising the steps of:

providing an elongated, substantially horizontally-disposed trough having a bottom and an upwardly-directed opening for accepting a napkin and an item of silverware positioned therein in preparation of a napkin-wrapping operation;

placing a napkin over the opening of the trough so that the central section of the napkin spans the width of the trough;

delivering an item of silverware onto the central section of the napkin so that the silverware item and napkin fall into the trough under the weight of the silverware item and so that the central section of the napkin is disposed between the silverware item and the bottom of the trough; and spinning the napkin and silverware item about the longitudinal axis of the trough so that the napkin is wrapped about the silverware item into a wrapped arrangement, wherein the spinning step includes the steps of positioning an elongated blade within and adjacent one side of the trough so that the longitudinal axis of the blade is substantially parallel to the longitudinal axis of the trough, and rotating the blade about the longitudinal axis of the trough so that the napkin is wrapped about the silverware item by the rotating blade.

17. A method for wrapping a napkin about an item of silverware wherein the napkin has edge sections and a central section which is bounded by the edge sections, the method comprising the steps of:

providing an elongated, substantially horizontally-disposed trough having a bottom and an upwardly-directed opening for accepting a napkin and an item of silverware positioned therein in preparation of a napkin-wrapping operation;

placing a napkin over the opening of the trough so that the central section of the napkin spans the width of the trough;

delivering an item of silverware onto the central section of the napkin so that the silverware item and napkin fall into the trough under the weight of the silverware item and so that the central section of the napkin is disposed between the silverware item and the bottom of the trough; and spinning the napkin and silverware item about the longitudinal axis of the trough so that the napkin is wrapped about the silverware item into a wrapped arrangement; and wherein the step of placing a napkin over the opening of the trough includes the steps of providing a pair of rollers and pinching the top napkin in a stack between the pair of rollers and moving the rollers and the napkin pinched therebetween to a position over the trough and releasing the napkin from between the rollers so that the napkin falls into a spread condition over the opening of the trough.

18. The method as defined in claim 17 wherein the step of delivering an item of silverware onto the central section of the napkin includes the steps of providing a platform, dispensing an item of silverware onto the platform from a plurality of silverware items arranged in a stacked relationship, and directing the dispensed silverware item onto the napkin positioned in spread condition over the opening of the trough.

* * * * *